US006722038B2

(12) United States Patent
Visman et al.

(10) Patent No.: US 6,722,038 B2
(45) Date of Patent: Apr. 20, 2004

(54) COUPLING FOR INTERNAL CUTTING MEMBER OF ROTARY SHAVING APPARATUS

(75) Inventors: Pieter Visman, Drachten (NL); Marc Kamerbeek, Drachten (NL); Albert Jan Aitink, Drachten (NL); Fransciscus Jozef Bosman, Drachten (NL); Mattheus Jacobus Van Der Meer, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 132 days.

(21) Appl. No.: 10/205,556

(22) Filed: Jul. 25, 2002

(65) Prior Publication Data

US 2003/0019107 A1 Jan. 30, 2003

(30) Foreign Application Priority Data

Jul. 30, 2001 (EP) ..... 01202895

(51) Int. Cl.[7] ..... B26B 19/14
(52) U.S. Cl. ..... 30/43.6; 464/106
(58) Field of Search ..... 30/43.6, 43.5, 30/346.51; 403/335; 464/106

(56) References Cited

U.S. PATENT DOCUMENTS 3,748,731 A * 7/1973 Kuiken et al. ..... 30/43.6
3,890,705 A * 6/1975 Tietjens ..... 30/43.6
4,257,161 A * 3/1981 Bijl et al. ..... 30/43.6
4,318,223 A 3/1982 Bergsma et al. ..... 30/43.6
5,031,315 A * 7/1991 Labrijn ..... 30/41
6,145,200 A * 11/2000 Jorna et al. ..... 30/43.6

* cited by examiner

*Primary Examiner*—Douglas D. Watts

(57) ABSTRACT

Shaving apparatus having at least one pivotable cutting unit (3) comprising an external cutting member (4) and an internal cutting member (6) which is drivable relative to said external cutting member, a drive mechanism (8) for driving said internal cutting member (6) into rotation, and a coupling member (18) having a coupling head (19) and a coupling body (20), which coupling head can be coupled to a coupling element (16) of the internal cutting member (6) in a detachable manner, said coupling body (20) being coupled to said driving mechanism (8). The coupling head (19) can be inserted into a cavity (21) of the coupling head (19). For driving said internal cutting member into rotation, the coupling head (19) comprises curved surfaces (25) for cooperation with surfaces (28) of said cavity (21). To improve the drive system, the coupling head (19) and the cavity (21) of the coupling element (16) have an approximately triangular shape which is rotationally symmetrical through 120°, as seen in the direction of the axis of rotation (24) of the coupling head (19).

8 Claims, 5 Drawing Sheets

COUPLING FOR INTERNAL CUTTING MEMBER OF ROTARY SHAVING APPARATUS

The invention relates to a shaving apparatus provided with at least one pivotable cutting unit comprising an external cutting member and an internal cutting member which can be driven into rotation with respect to the former, a drive mechanism for driving the internal cutting member into rotation, and a coupling member comprising a coupling head and a coupling body, which coupling head can be detachably coupled to a coupling element of the internal cutting member, said coupling body being coupled to the drive mechanism, which coupling member has an axis of rotation and which coupling head is provided with curved drive surfaces between which curved connecting surfaces are situated, while, seen in a plane substantially transverse to the drive surface and containing the axis of rotation, each drive surface has a curvature with a first radius of curvature whose center lies substantially on the axis of rotation, and each connecting surface has a curvature with a second radius of curvature whose center coincides with the center of the first radius of curvature, said second radius of curvature being greater than said first radius of curvature, and the coupling element of the internal cutting member is provided with a cavity in which the coupling head can be accommodated and which is provided with drive surfaces for cooperating with the curved drive surfaces of the coupling head.

Such a shaving apparatus is known from U.S. Pat. No. 3,748,731. Seen in the direction of the axis of rotation, both the coupling head of the coupling member and the cavity of the coupling element of the internal cutting member have a rectangular shape with two long and two short sides. The two mutually opposed long sides of the coupling head form the curved drive surfaces, while the short sides form the curved connecting surfaces. The curved surfaces render it possible for the cutting unit to pivot in all directions (floating shaving heads), so that the cutting unit will satisfactorily lie against the skin during shaving. While driving the internal cutting member, the coupling head makes contact with the coupling element of the internal cutting member in two locations, i.e. the cooperating drive surfaces are in mutual contact in one location at any time. These contact locations are approximately diametrically opposed to one another with respect to the axis of rotation. This is referred to as a two-point coupling or drive. In practice, the coupling head will always fit the cavity of the coupling element with some clearance. A disadvantage of this coupling is that the coupling head can shift in the cavity of the coupling element in the direction of the connecting surfaces during driving. This is obviously dependent on the tolerances. At greater pivot angles, the coupling head is pulled to one side in the cavity, so that the coupling head no longer lies correctly centered in the cavity. The result is that the coupling head moves to and fro in the cavity during the rotary movement, which leads to stronger wear. More wear means more play, and accordingly a further deterioration of this aspect. The noise level will also increase as a result of this. It is attempted to keep this disadvantage as small as possible by making the tolerances of the coupling head and the cavity as narrow as possible. Narrow tolerances, however, imply a more expensive manufacture and more rejects.

It is an object of the invention to improve the coupling between the coupling member and the pivotable internal cutting member in a shaving apparatus described in the opening paragraph to the extent that the coupling is free from play during the drive.

To achieve this object, the shaving apparatus is characterized in that both the coupling head and the cavity of the coupling element have an approximately triangular shape which is rotationally symmetrical through 120°, seen in a direction along the axis of rotation.

During the drive operation, the coupling head makes contact with the walls of the cavity, which form the drive surfaces of the coupling element, in three locations. This leads to a so-called three-point coupling. The coupling head remains centered in the triangular cavity during the drive, also in the case of a comparatively great pivoting movement of the internal cutting member. Compared with the known coupling of U.S. Pat. No. 3,748,731, the coupling head according to the invention is allowed to fit the cavity with a comparatively large clearance. The mutually cooperating drive surfaces remain in contact with one another during the drive without the drive surfaces starting to slide along one another, at least as seen in a cross-section transverse to the axis of rotation. It is obviously possible for the drive surfaces to slide over one another in the direction of the pivoting movement of the internal cutting member.

In a preferred embodiment, each curved drive surface of the coupling head has a slight curvature, seen in a plane perpendicular to the axis of rotation. The slight curvature ensures that the point of contact between the cooperating drive surfaces will also lie on the curved drive surface of the coupling head and not on the edge between the drive surface and the connecting surface. The risk of wear is further reduced thereby.

A further embodiment is characterized in that the upper side of the coupling head is provided with a spherical bearing surface for cooperating with a bearing surface situated in the center of the cavity of the coupling element of the internal cutting member, which spherical bearing surface has a curvature with a radius of curvature whose center lies on the axis of rotation, which center, seen in the direction of the axis of rotation, is at a greater distance from the spherical bearing surface than is the center of the curved drive surfaces. In other words, the center of curvature of the spherical bearing surface lies below the center of curvature of the curved drive surfaces. A greater stability is achieved by means of this construction during operation of the shaving apparatus, so that substantially no vibrations will arise.

A yet further embodiment is characterized in that the coupling element is provided with sloping inlet surfaces for coupling to the coupling member. The sloping inlet surfaces facilitate the entry of the coupling head into the cavity of the coupling element.

The invention also relates to a cutting unit with an external cutting member and an internal cutting member which can be driven in rotation with respect to the former, comprising a coupling element provided with a cavity having a substantially triangular shape, designed for use in the shaving apparatus mentioned above.

The invention will now be explained in more detail with reference to an embodiment shown in the drawings.

Figure 1:
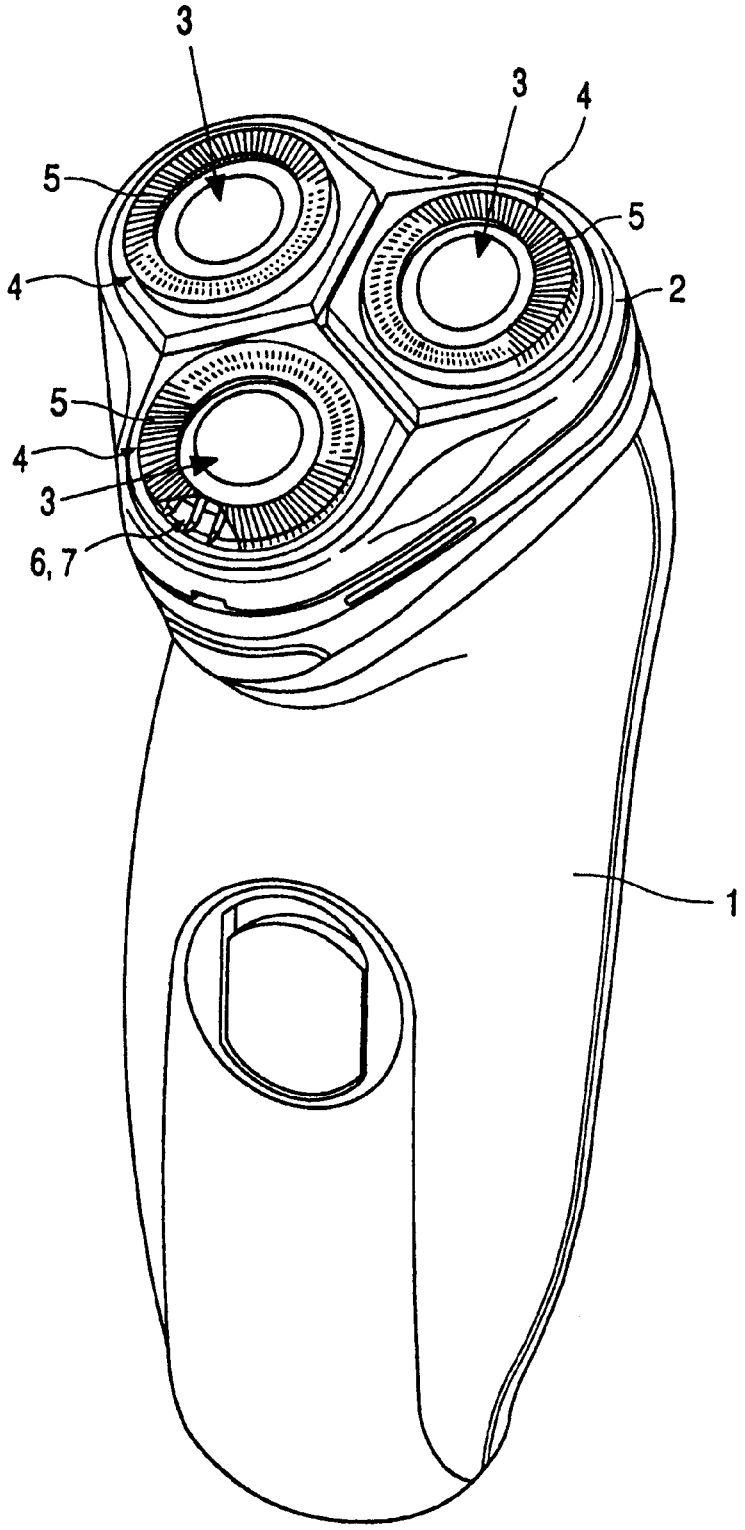
FIG. 1 shows a shaving apparatus with three cutting units.
Figure 3:
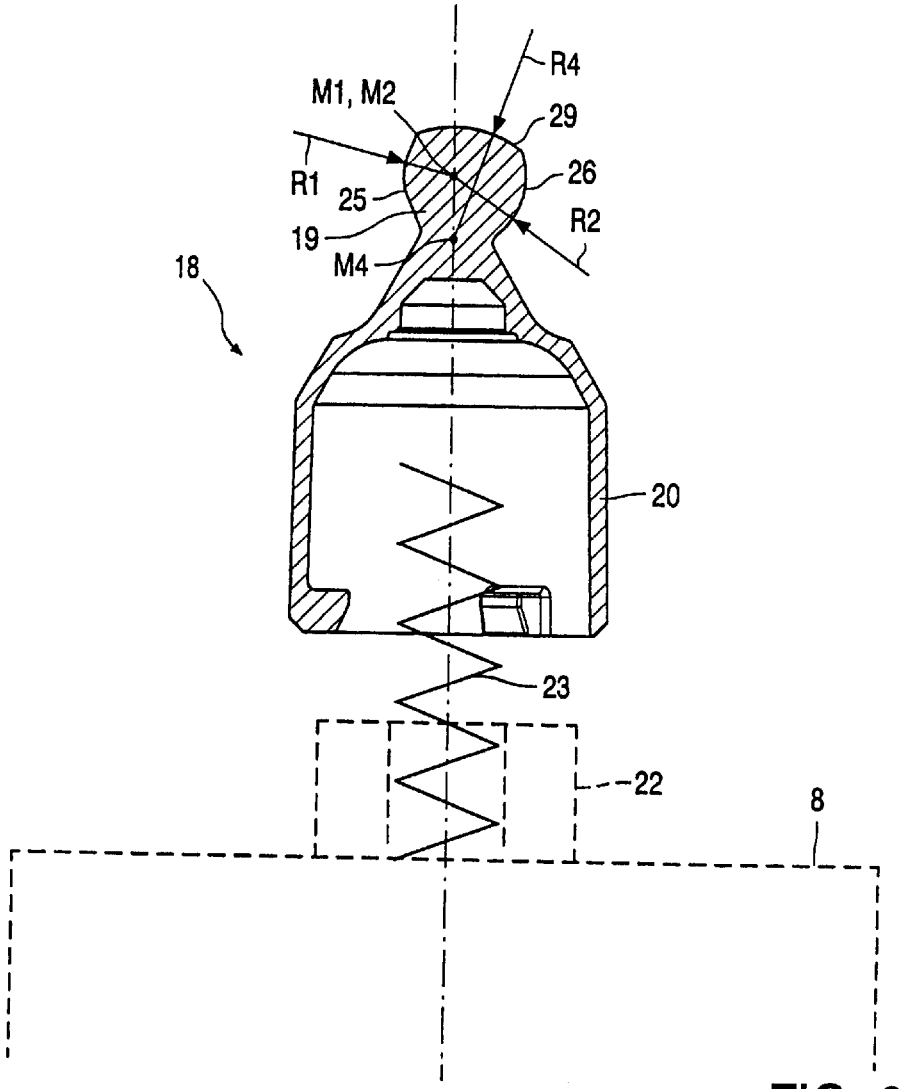
Figure 4:
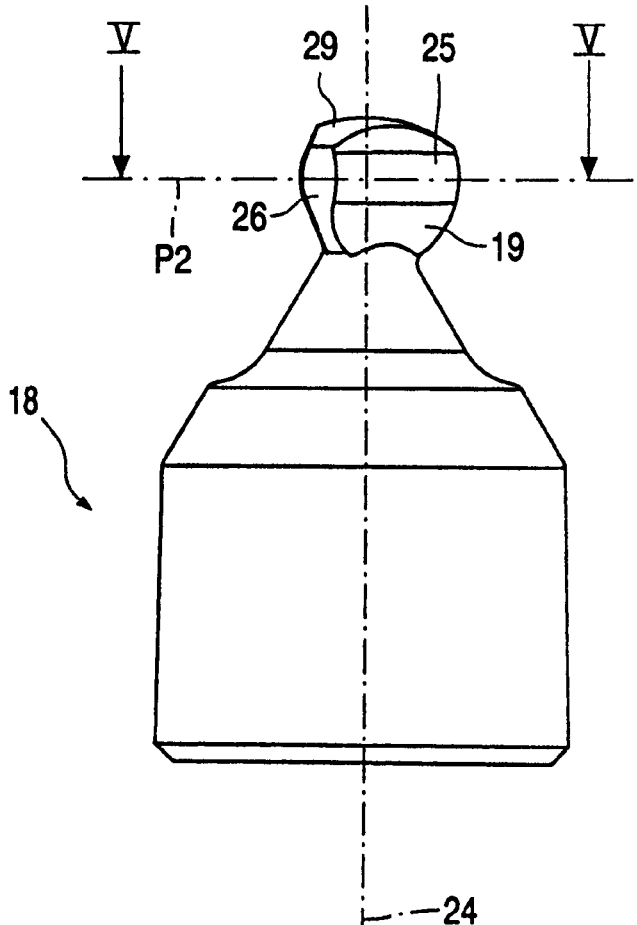
Figure 5:
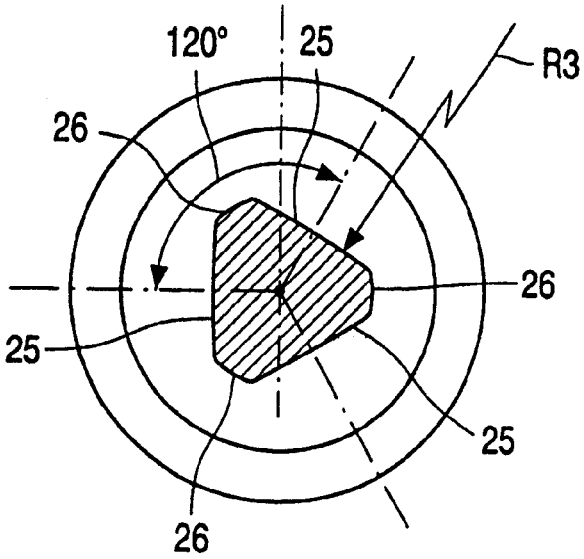
Figure 6:
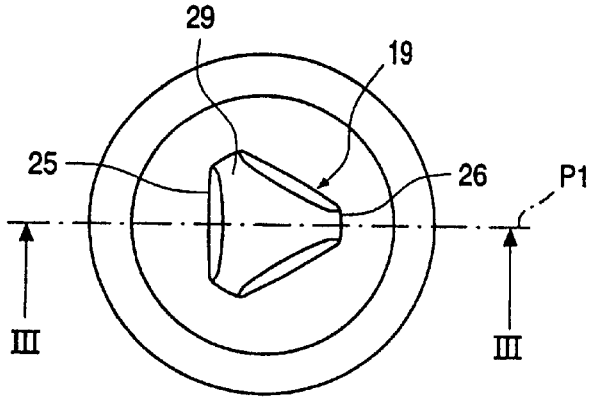
Figure 7:
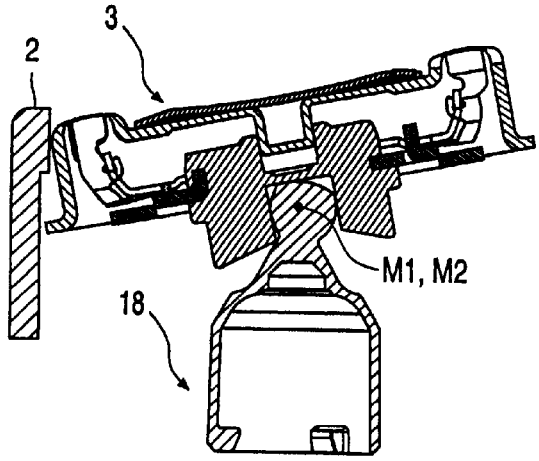
Figure 8:
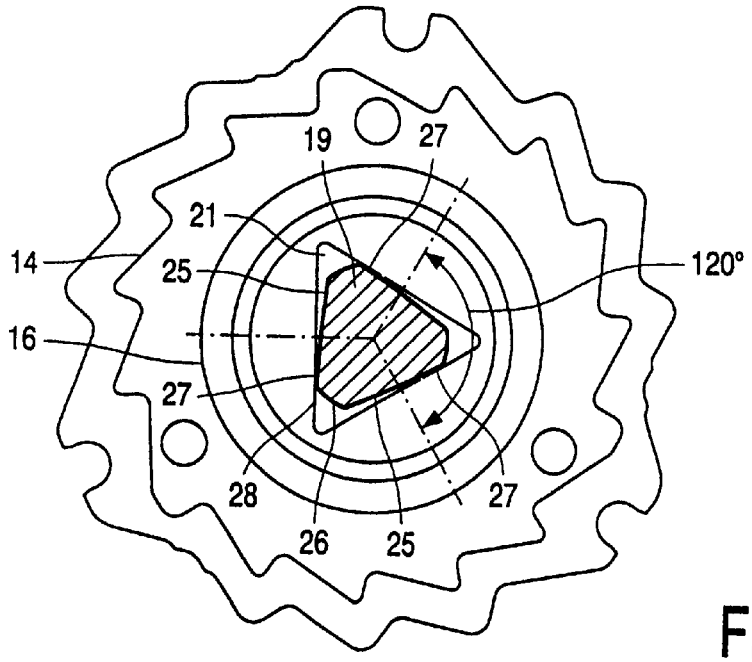
Figure 9:
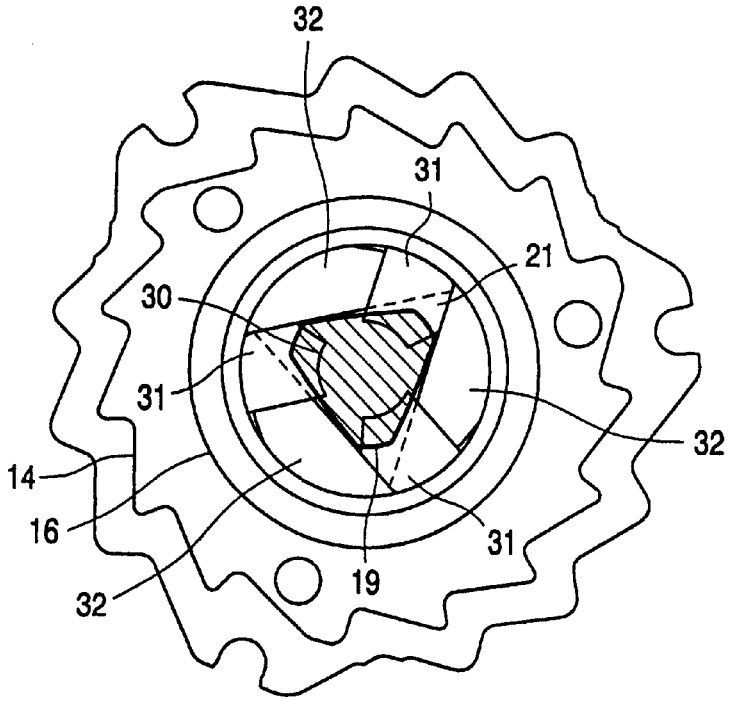
Figure 10:
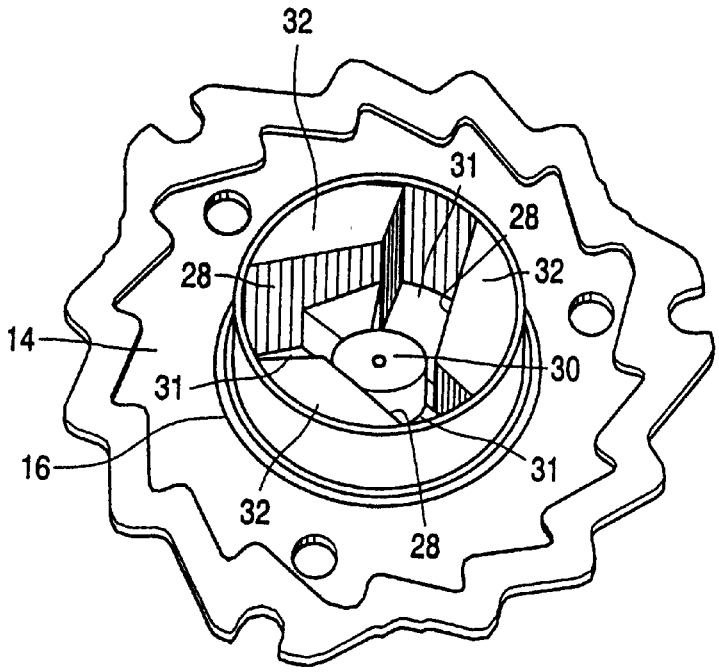

FIG. 3 is a cross-sectional view of the coupling member taken on the line III—III in FIG. 6, FIG. 4 is a side elevation of the coupling member, FIG. 5 is a cross-sectional view of the coupling member taken on the line V—V in FIG. 4, FIG. 6 is a plan view of the coupling member of FIG. 4, FIG. 7 shows the cutting unit in a tilted position, FIG. 8 is a bottom view of the coupling element of the cutting unit of FIG. 1, FIG. 9 is a bottom view of the coupling element in a further embodiment of the coupling element of FIG. 8, and FIG. 10 shows the coupling element of FIG. 9 in perspective view.

FIG. 1 shows a rotary shaving apparatus with a housing 1 and a shaving-head holder 2 which is detachable from the housing and/or is hinged to the housing. Three cutting units 3, also denoted shaving heads, are present in the shaving-head holder, each having an external cutting member 4 with hair trap openings 5 and an internal coupling member 6 with cutter elements 7 which can be driven into rotation with respect to the former member. The internal cutting member is driven by a motor 8 accommodated in the housing.

Figure 2:
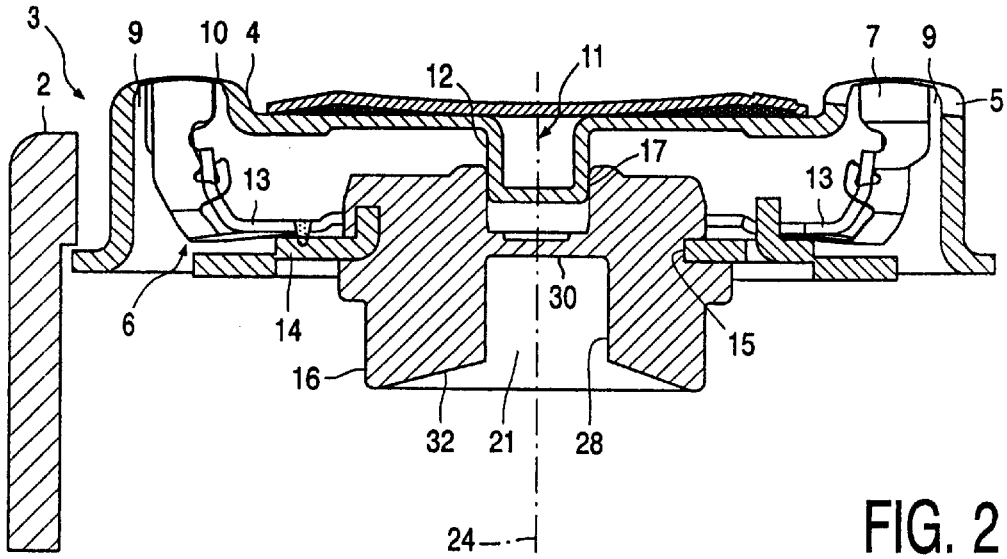
FIG. 2 is a cross-sectional view of a cutting unit of FIG. 1.

FIG. 2 shows one of the cutting units 3 on an enlarged scale. The external cutting member 4, which has the shape of a circular cap, is provided with a circular groove 9. A large number of lamellae 10 which are substantially radially directed with respect to the center of the cap are present in the bottom and the vertical side walls of the groove, between which lamellae the slotted hair trap openings 5 extend. The external cutting member is provided with a central bearing shaft which extends in axial direction. The bearing shaft is formed by a projection 12 of the external cutting member. The internal cutting member 4 is formed by a central portion 13 with the cutter elements 7 at the circumference thereof. The ends of these cutter elements have cutting edges which cooperate with mating edges of the lamellae 10 for cutting off hairs which project through the hair trap openings 5. The central portion 13 is fastened to an annular plate 14 with a central opening 15. A coupling element 16 is fastened to the annular plate 14 in the central opening 15. The coupling element is provided with a bearing bush 17 in which the bearing shaft 11 of the external cutting member is journaled.

The internal cutting member 4 is driven by a coupling member 18 which comprises a coupling head 19 and a coupling body 20. The coupling element 16 for this purpose has a cavity 21 in which the coupling head 19 can be accommodated. The coupling body 20 is fastened to a drive shaft 22 of the motor 8 with resilience in axial direction. A spring 23 is for this purpose mounted between the coupling body 20 and the drive shaft 22. The axis of rotation of the coupling member 18 is referenced 24. As FIGS. 4 to 6 show, the coupling head 19, seen in the direction of the axis of rotation 24, has a substantially triangular shape which is rotationally symmetrical through 120°. The coupling head 19 has three curved drive surfaces 25 between which curved connecting surfaces 26 are present. FIG. 3 shows the coupling member 18 in a cross-section in a plane P1 (cross-section III—III in FIG. 6) in which the axis of rotation 24 lies and which is transverse to a drive surface 25. This plane of the cross-section is also perpendicular to the connecting surface 26 because of the rotational symmetry through 120°. Viewed in this cross-section (FIG. 3), each drive surface 25 has a curvature with a first radius of curvature R1 whose center M1 lies on the axis of rotation 24. In the same cross-section, each connecting surface 26 has a curvature with a second radius of curvature R2 whose center M2 also lies on the axis of rotation 24 and coincides with the center M1 of the curved drive surface 25. The radius of curvature R2 is greater than the radius of curvature R1 here. The center M1, M2 may be regarded as the drive center of the drive mechanism. During operation of the shaving apparatus, the cutting unit 3 is capable of pivoting over the coupling head 19, in which M1, M2, is the center of the pivoting movement. This is shown in FIG. 7. Furthermore, each curved drive surface 25 of the coupling head 19 has a slight curvature with a great radius of curvature R3, seen in a plane P2 (cross-section V—V) perpendicular to the axis of rotation 24 (see FIG. 5), such that R3 is much greater than R1 or R2. The reason for this will be explained below.

FIG. 8 is a bottom view of the coupling element 16 of the internal cutting member 6. The cavity 21 has a triangular shape which is rotationally symmetrical through 120°, as is the coupling head 19. A bold line in this Figure indicates the coupling head 19. It is apparent that the coupling head makes contact with the walls of the cavity 21 in three locations, i.e. the curved drive surfaces 25 of the coupling head 19 bear on the drive surfaces 28 of the coupling element in three spots 27. The slight curvature with the great radius of curvature R3 of the drive surface 25 ensures that the point of contact 27 of the cooperating drive surfaces 25, 28 will always lie on the drive surface 25 and not on the edge between the drive surface 25 and the connecting surface 26.

The coupling head 19 has an upper surface which is constructed as an axial spherical bearing surface 29 (see FIGS. 3 and 4). The spherical bearing surface 29 cooperates with an axial bearing surface 30 of the coupling element 16 (FIG. 2) situated in the center of the cavity 21. This spherical bearing surface has a curvature with a radius of curvature R4 whose center M4 lies on the axis of rotation 24 (FIG. 3). The radius of curvature R4 is greater than the radii of curvature R1 and R2, viewed in the direction of the axis of rotation 24. The center M4 thus lies below the drive center M1, M2, which achieves a greater stability.

FIGS. 9 and 10 show a further embodiment of the coupling member as shown in FIG. 8. The triangular cavity 21 is provided with three recesses 31 which are directed radially outwards and which extend as openings transversely through the coupling element 16 (see FIG. 10). These openings prevent contaminations, especially cut-off hairs with skin grease, from entering the cavity 21, which could hamper the insertion of the coupling member into the cavity. These contaminations are sucked through the openings during operation of the shaving apparatus and will not enter between the coupling parts. The coupling element 16 is further provided with sloping inlet surfaces 32 (see also FIG. 2) which facilitate the introduction of the coupling head 19 into the cavity 21 when the holder 2 with the cutting unit 3 is placed on the housing 1.

What is claimed is:

1. A shaving apparatus provided with at least one pivotable cutting unit (3) comprising an external cutting member (4) and an internal cutting member (6) which can be driven in rotation with respect to the former (4), a drive mechanism (8) for driving the internal cutting member (6) into rotation, and a coupling member (18) comprising a coupling head (19) and a coupling body (20), which coupling head (19) can be detachably coupled to a coupling element (16) of the internal cutting member (6), said coupling body (20) being coupled to the drive mechanism (8), which coupling member has an axis of rotation (24), and which coupling head (19) is provided with curved drive surfaces (25) between which curved connecting surfaces (26) are situated, while, seen in a plane (P1) substantially transverse to the drive surface (25) and containing the axis of rotation (24), each drive surface (25) has a curvature with a first radius of curvature (R1) whose center (M1) lies substantially on the axis of rotation (24), and each connecting surface (26) has a curvature with a second radius of curvature (R2) whose center (M2) coincides with the center (M1) of the first radius of curvature (R1), said second radius of curvature (R2) being greater than said first radius of curvature (R1), and the coupling element (16) of the internal cutting member (6) is provided with a cavity (21) in which the coupling head (19) can be accommodated and which is provided with drive surfaces (28) for cooperating with the curved drive surfaces (25) of the coupling head (19), characterized in that both the coupling head (19) and the cavity (21) of the coupling element (16) have an approximately triangular shape which is rotationally symmetrical through 120°, seen in a direction along the axis of rotation (24).

2. A shaving apparatus as claimed in claim 1, characterized in that each curved drive surface (25) of the coupling head (19) has a slight curvature, seen in a plane (P2) perpendicular to the axis of rotation (24), with a great radius of curvature (R3).

3. A shaving apparatus as claimed in claim 1, characterized in that the upper side of the coupling head (19) is provided with a spherical bearing surface (29) for cooperating with a bearing surface (30) situated in the center of the cavity (21) of the coupling element (16) of the internal cutting member (6), which spherical bearing surface (29) has a curvature with a radius of curvature (R4), whose center (M4) lies on the axis of rotation (24), which center (M4), seen in the direction of the axis of rotation (24), is at a greater distance from the spherical bearing surface (29) than is the center (M1, M2) of the curved drive surfaces (24).

4. A shaving apparatus as claimed in claim 1, characterized in that the coupling element (16) is provided with sloping inlet surfaces (32) for coupling to the coupling member (18).

5. A shaving apparatus as claimed in claim 1, characterized in that the coupling element (16) is provided with recesses (31) which directly adjoin the cavity (21).

6. A shaving apparatus as claimed in claim 1, characterized in that the coupling member (18) is resiliently fastened to the drive shaft (22) of a motor (8), with resilience in the direction of the axis of rotation (24).

7. A cutting unit (3) with an external cutting member (4) and an internal cutting member (6) which can be driven into rotation with respect to the former (4), comprising a coupling element (16) provided with a cavity (21) having a substantially triangular shape for use in the shaving apparatus as claimed in claim 1.

8. A cutting unit as claimed in claim 7, characterized in that the coupling element (16) is provided with recesses (31) which directly adjoin the cavity (21).

* * * * *